US012560062B2

(12) United States Patent
Malekzadeh et al.

(10) Patent No.: US 12,560,062 B2
(45) Date of Patent: Feb. 24, 2026

(54) METHOD AND DEVICES FOR UNLOADING FLOW CONDUITS AND IMPROVING MULTI-PHASE FLOW CAPACITY

(71) Applicant: Energy Transition Technologies B.V., Amstelveen (NL)

(72) Inventors: Reza Malekzadeh, The Hague (NL); Mark Gilbert Sisouw de Zilwa, Amstelveen (NL)

(73) Assignee: Energy Transition Technologies B.V., Amstelveen (NL)

( * ) Notice: Subject to any disclaimer, the term of this patent is extended or adjusted under 35 U.S.C. 154(b) by 0 days.

(21) Appl. No.: 18/396,483

(22) Filed: Dec. 26, 2023

(65) Prior Publication Data

US 2024/0167370 A1 May 23, 2024

Related U.S. Application Data

(63) Continuation of application No. PCT/NL2022/050381, filed on Jul. 4, 2022.

(30) Foreign Application Priority Data

Jul. 2, 2021 (NL) ..... 1044081

(51) Int. Cl.
*E21B 43/12* (2006.01)
*E21B 17/18* (2006.01)

(52) U.S. Cl.
CPC ..... *E21B 43/13* (2020.05); *E21B 17/18* (2013.01); *E21B 2200/20* (2020.05)

(58) Field of Classification Search
CPC ..... E21B 43/13; E21B 17/18; E21B 2200/20
See application file for complete search history.

(56) References Cited

U.S. PATENT DOCUMENTS

| | | | | |
|---|---|---|---|---|
| 2,905,099 A * | 9/1959 | Turner | E21B 43/12 | 166/54.1 |
| 3,036,634 A * | 5/1962 | Corley, Jr. | E21B 43/14 | 166/305.1 |
| 3,580,332 A * | 5/1971 | Dean | E21B 23/06 | 166/151 |
| 6,257,332 B1 * | 7/2001 | Vidrine | E21B 43/12 | 166/250.15 |
| 6,354,378 B1 * | 3/2002 | Patel | E21B 43/14 | 166/321 |

(Continued)

FOREIGN PATENT DOCUMENTS

WO 2023277693 A1 1/2023

*Primary Examiner* — Yanick A Akaragwe
(74) *Attorney, Agent, or Firm* — Peacock Law P.C.; Justin R. Muehlmeyer; Daniel J. Berenger-Russell

(57) ABSTRACT

A pathway section in a tubing system for transporting a gas-liquid flow from a petroleum wellbore to a production point. The pathway section includes a first tubing portion directing the flow towards the production point and a second tubing portion inserted within the first tubing portion, along with other features described herein directing the flow in a manner that makes more wall surface available for liquid transport, which results in a greater liquid lifting capacity, and optimize gas velocity distribution over the cross-section of the pipes, which results in a greater upward shear stress exerted by the gas phase on the liquid phase. Methods of operating and use of the system are also described.

9 Claims, 10 Drawing Sheets

(56) References Cited

U.S. PATENT DOCUMENTS

| | | | | |
|---|---|---|---|---|
| 6,367,555 | B1 | 4/2002 | Senyard et al. | |
| 8,555,978 | B2 | 10/2013 | Kenworthy et al. | |
| 2011/0127029 | A1 | 6/2011 | Ganelin et al. | |
| 2011/0247813 | A1* | 10/2011 | Moen | E21B 43/12 166/278 |
| 2012/0298377 | A1 | 11/2012 | Smith et al. | |

* cited by examiner

METHOD AND DEVICES FOR UNLOADING FLOW CONDUITS AND IMPROVING MULTI-PHASE FLOW CAPACITY

CROSS-REFERENCE TO RELATED APPLICATIONS

This application is a continuation of International Application No. PCT/NL2022/050381, entitled "Method and Devices for Liquid Unloading of Gas Wells", filed Jul. 4, 2022, which claims priority to Netherlands Patent Application No. 1044081, entitled "Method and Devices for Unloading Flow Conduits and Improving Multi-Phase Flow Capacity", filed Jul. 2, 2021, and the specifications and claims thereof are incorporated herein by reference.

BACKGROUND OF THE INVENTION

Field of the Invention

Multi-phase flows (liquid-gas-solid) are encountered in various industrial fields such as chemical and process, nuclear reactor, space, geothermal energy and petroleum. In a multi-phase flowing well or pipeline system, various flow configurations or patterns exist. Liquid phase (hydrocarbon and/or water) and gas phase are often encountered in such a system. The resulting flow pattern depends on the relative magnitudes of the forces acting on the fluids. At a relatively low gas-liquid ratio, the fluid flows as a bubbly flow with discrete bubbles of gas phase distributed throughout the continuous liquid phase. At a relatively high gas-liquid ratio, the fluids are transported as an annular flow. Here, the continuous gas phase flows through the center of the pipe and often contains entrained liquid droplets. The liquid phase flows through the annulus formed by the pipe wall and the flowing gas core, along the pipe walls. At intermediate gas-oil ratios, slug and churn flow patterns occur.

When a well or a pipe is flowing under the annular flow pattern, the efficiency coefficient—defined as the ratio of the gas-phase's energy that is being actually used for the liquid displacement to the total energy of the gas phase which can potentially be used for the liquid displacement—reduces substantially in comparison with the other flow patterns such as bubbly flow. The gas phase occupies the main fraction of the space for the fluid flow and the quantity of the transported liquid is relatively low. In liquid-producing wells (oil and/or water) this low efficiency coefficient accelerates the degasification of the reservoir formation and reduces the liquid production. In gas wells, this reduction in the gas energy to unload the liquids (water and/or condensate), triggers the liquid loading which hampers gas production and eventually kills the production well.

In order to explain the theory behind the invention, we first consider an existing technical solution to delay liquid loading in gas producing wells, which is called the velocity string "US2012298377A1·2012-11-29", hereinafter referred to as "US'377", was granted as U.S. Pat. No. 8,555,978B2 with the following claim:

A tubing system for transporting a gas-liquid flow from a petroleum wellbore to a production point, the tubing system comprising a dual pathway section in fluid communication with the wellbore and the production point, said dual pathway section comprising:

a first tubing portion directing said flow towards the production point, a second tubing portion comprising a plurality of parallel channels, bundled or commonly formed together in a pipe said second tubing portion directing said flow towards the production point, a first valve to direct said flow from the well to either the first tubing portion or the second tubing portion, whereby when in said second tubing portion, said gas-liquid flow is divided into a plurality of individual flows through said plurality of parallel channels along at least a portion of said second tubing portion. The production point can be understood to be the point where the fluid is processed (separated into gas, oil and water). Such production point for subsea petroleum wells is typically the surface platform. Land-based multi-phase tubing systems typically consist of gathering lines to concentrate produced fluid at one large processing facility. As can be seen from all embodiments of the invention according to US'377, the second tubing system extends within the first tubing along its length. US'377 here already describes a different tubing system than the use of an ordinary velocity string in a pipeline.

US'377 resolves the problem of local stagnation of flow due to the formation of fluid columns. By using a plurality of smaller channels, such stagnation is prevented at the cost of substantially restricting the flow area of the original pipeline.

A downside of the ordinary velocity string in a pipeline is also that it is often a relatively small diameter coiled tubing that is lowered into the original production tubing to restrict the available cross-sectional flow area.

The velocity string works on the basis of (i) an adjusted/increased velocity distribution across the vertical cross section of the string, (ii) a higher shear stress which is caused by the adjusted velocity distribution, and exercised by the annular gas phase on the liquids traveling along the walls of the string.

As an example, in the petroleum industry, when a gas producing well has problems to unload its fluids due to liquid accumulation, the velocity string is typically used which has a reduced diameter available for fluid flow. As a result, the gas-phase velocity in the smaller size tubular will increase. The gas-phase velocity distribution profile (see FIG. 6) will change such that the shear stress at the walls of the velocity string is higher compared to the original-larger-diameter-production tubing (see FIG. 4). The shear stress—proportional to the viscosity multiplied by velocity derivative with respect to radius, $\mu \times dV/dr$—exercised by the gas on the liquid film moving along the tube walls is one of the main forces moving the liquids up to the surface.

This means that the gas phase in the center exercises a larger force on the liquids moving along the wall, causing the well to unload its liquids easier and more than in the original larger-diameter production tubing.

Since the liquids advance along the wall, usually in a film-like fashion, the flow area and wall surface are reduced, thereby limiting the flow of liquids in a multi-phase fluid flow and limiting the gas production capacity and liquid unloading capacity.

The reduction in flow area is inevitable as the introduction of smaller tubes in a larger tube causes a packing problem. For example, the spatial packing of such channels follows a so called "densest packing" law. This is similar to the packing problem of circles in a two-dimensional Euclidean plane. This principle was proved by Joseph Louis Lagrange in 1773 when he found the densest packing for such circles to never exceed 90.69% of the available volume.

What is needed is a tubing system that transports a gas-liquid flow from a petroleum wellbore to a production point that does not suffer these problems of reduced flow area.

BRIEF SUMMARY OF THE INVENTION

Embodiments of the present invention are directed to a tubing system for transporting a gas-liquid flow from a petroleum wellbore to a production point, the tubing system comprising a pathway section in fluid communication with the wellbore and the production point, the section comprising: a first tubing portion directing said flow towards the production point; at least one second tubing portion having been inserted within said first tubing portion, wherein said at least one second tubing portion comprises a packer, wherein the at least one second tubing portion is furnished within said first tubing, such that the flow exclusively enters the first tubing portion above the packer via the at least one second tubing portion, wherein the at least one second tubing portion comprises a lateral opening and a distal opening for enabling a first flow path from said distal opening towards the first tubing portion, and enabling a second flow path from the distal end of the first tubing portion and the lateral opening, wherein the second flow path extends between an inner surface of the first tubing portion and the outer surface of the at least one second tubing portion, and wherein both the first and second flow paths merge below the packer, and comprising a sliding side door arranged for covering the lateral opening to enable reversibly switching the system between a first operational mode in which the first and second flow paths are simultaneously enabled, and a second operational mode in which only the first flow path is enabled.

The velocity string, here the at least one second tubing portion, is preferably hung-off by means of a so-called "tension packer", interchangeably used with the term "packer", inside the original production tubing. This original tubing is here represented by the first tubing portion. The tension packer is energized by the weight of the hung off velocity string, which may be provided as coiled tubing.

The sliding side door is preferably located at the top of the velocity string/coiled tubing directly under the tension packer. That is to say, the sliding side door, and corresponding lateral openings, are provided at the proximal end portion of the at least one second tubing portion, within a distance of about 0 to about 10 meters upstream of tension packer.

The insertion of a tube within a tube to improve liquid unloading capacity and/or flow capacity is very much counter intuitive due to the packing problem, so much so that US'337 only considers directing a flow to either one of the first or second tubing pointing thereby steering away from any integrated solution which involves any sort of simultaneous operation.

Contrary to the velocity string solution, the flow area available to production is nearly entirely unchanged compared to an unamended original production tube consisting of a singular tube portion, whereas the wall surface for the liquid transportation is considerably increased allowing the film to both advance along inner and outer surfaces of the first tubing portion and at least one second tubing portion. Key benefits of the present invention compared to the existing solutions include that: (i) the velocity distribution is different compared to the original production tubing (see FIG. 5 and FIG. 4), although the average gas-phase velocity is relatively unchanged, which causes the shear stress of the gas phase on the liquids phase at the tubular walls to be higher; (ii) a considerable increase of the wall surface which is subject to increased shear stress available to the liquids to travel up the walls; and (iii) the tubular flow area available for gas flow is relatively unchanged to the original production tubing and larger than known velocity string solutions. The present invention (i) has a similar positive effect on the velocity distribution as the existing velocity string, so increased shear stress effect, but (ii) has a considerable higher wall surfaces and resulting liquids unloading capacity than the existing velocity string solutions, and (iii) has the similar production volume as the original production tubing.

Further differences of the present invention compared to the existing multi-channel solutions "US2011127029A1.2011-06-02" include (i) that the present invention makes use of a combination of a velocity string, such as coiled tubing or threaded tubing, with a Sliding Side Door ("SSD"), also known as a slideable side door, and a removable plug (FIGS. 7-9), also called a retrievable plug, which feature is also not present in existing solutions in the industry. In one example, the system comprises an additional tubing portion extending upstream from the tubing portion comprising the plurality of tubular channels, wherein the further tubing portion has a distal inlet and a secondary inlet stream upward from the distal inlet, and wherein the further tubing portion further comprises a slidable side door covering said secondary inlet. As previously mentioned, but here emphasized, each of the tubular channels may in this example be made of coiled tubing. It is noted that the term coiled tubing does not refer to the state of the tube actually being coiled, rather in the oil and gas industries, coiled tubing refers to a metal tubing that can be spooled on a reel. The retrievable plug would in practice best be located below the SSD (sliding side door) by installing a nipple profile on the at least one second tubing portion, such that the retrievable plug can be inserted or removed therefrom. This improves the retrievability of the plug compared to putting the plug all the way down at the bottom of the string as indicated in FIG. 8, since the plug may be damaged by transport through the at least one second tubing portion. The plug works to the same effect in either arrangement.

The system may also include a safety valve above the packer, wherein the safety valve is operable for blocking the flow to the production plant in its entirety. This feature is not known from the prior art for blocking a flow downstream from a merging point of a plurality of flow paths which beneficially substantially increases the safety of production point personnel by enabling a singular valve to shut down the entire flow. The safety valve itself is a known industry standard for blocking flows from a well.

Further according to a first embodiment of the invention, a retrievable plug may be arranged to cover the distal opening of the at least one second tubing portion. A retrievable plug is used to close off velocity strings. In one example, the retrievable plug is preferably a high expansion retrievable plug known as a HEX. The retrievable plug can be lowered into the velocity string and can be controlled from a distance by means of a cable to grip or let go from an inner surface of the velocity string. The plug is thereby retrievable through the velocity string itself. In other words, the plug is designed for being manipulated so as the switch the system between a first operational mode in which the first and second flow paths are simultaneously enabled, and a third operational mode in which only the second flow path is enabled. The retrievable plug may here be set or retrieved from a nipple profile provided to an inner surface of at least one second tubing portion. As used throughout this application, a nipple profile means a locally reduced diameter internal profile that provides a positive indication of seating by preventing the plug from passing beyond the nipple. The nipple here may even be designed so as to provide a barrier to protect against the plug from being run or dropped below the profile. Such a profile would protect any filers and/or sand control provided within said at least one second tubing portion.

In another embodiment compatible with each and all previously mentioned features, the lateral opening of the at least one tubing portion is provided directly below the packer, such that the second flow path extends along about 90& to about 100% of the entire length of the at least one second tubing portion below the packer. This beneficially prevents the reemergence of a liquid column above the merging point, so that the velocity of the gas of multi-phase flow will always bridge any static pressure that would build up as a result of the liquid forming a column within a part of the tubing system.

In order to reduce the susceptibility of the tubing system to contaminants the system may be fitted with a sand control and/or filter device. Such sand control and/or filter device would be provided within both the distal end section of the at least one second tubing portion as well within the section of the at least one second tubing portion comprising the lateral opening. It should be understood that the lateral opening can consist of a plurality of lateral drill holes or other perforations. One form of sand control is providing the at least one second tubing portion with a slotted liner. The person skilled in the art will know the various industry standard sand control and filers that are available to him or her. Beneficially, this prevents any fluid film from carrying sand particles in an upward direction.

In another embodiment of the present invention, the at least one tubing portion comprises a plurality of substantially parallel tubing portions each provided as a velocity string. This design beneficially increases the surface available to the liquid portion of the multi-phase flow to progress upwardly along. This allows the system to operate in wells where other systems would be particularly susceptible to static pressure build up in the form of liquid columns. In another embodiment, the at least one tubing portion comprises a plurality of substantially concentric tubing portions, wherein the second flow path is further subdivided in a plurality of sub-paths which also extend between inner and outer surfaces of the concentric tubing portions. In this example, a yet further packing limit can be circumvented and allowing a more uniform distribution of flow and film. In one example the part of the first tubing portion above the packer is only about 5 to about 100 m long, and the part of the first tubing portion below the packer is greater than the tubing portion below the packer, such as at least about 1000 m, more commonly about 2000 m to about 4000 m.

According to a second embodiment of the present invention, there is provided a method of constructing a tubing system according the first embodiment of the invention comprising the following steps: providing the first tubing portion; providing the at least one second tubing portion; and lowering the at least one second tubing portion into the first tubing portion, such that the at least one second tube portion hangs in the first tube portion on the packer.

According to a third embodiment of the present invention, a method of using the tubing system according the first embodiment of the invention comprises the step of operating the sliding side and/or plug door to switch between any one of the first, second and third operational modes.

According to a fourth embodiment of the present invention, a computer implemented method comprises: (a) simulating a system according to any of the preceding claims with a predetermined number of concentric second tubing portions of predefined radii; (b) changing the number of concentric tubing portions that make up the plurality within a predefined range, such as 1-4, and the respective radii within a predefined range, and repeating the simulation step (a); (c) iterating towards a simulated final system with a higher simulated liquid unloading capacity and/or flow capacity by repeating step (b); and (d) providing system having a first tubing portion with at least second tubing portions such that it corresponds to the simulated final system.

The person skilled in the art will understand that there is a variety of fluid dynamic programs at his or her disposal for performing such a simulation. Flow calculations may, merely for the sake of example, be made in Visual Basic, but should not be considered limited thereto.

Depending on the specific flow assurance issues, various sand control and/or filter devices may also be employed in the present invention, which devices can be mounted at the bottom of the tubular devices (FIG. 10). The phrase "tubular devices" as used in this application refers to the tubing portion including the plurality of tubular channels.

One of the tubulars or a dedicated injection line can be used for transporting special fluids down the flow device such as corrosion inhibitor, foam, acid, scale inhibitor, etc. in order to mitigate potential flow assurance issues (FIG. 10). To this end, the optimum tubular solution (number of tubulars and their radii as well as the moment of changing from one to another tubular configuration via sliding slide door and/or plug) are calculated based on a proprietary dynamic simulation tool taking the principle of the Computational Fluid Dynamic into account, in order to maximize the liquid unloading capacity.

FIG. 1-FIG. 3 illustrate a concentric flow device according to an embodiment of the present invention with one or more tubulars or velocity strings inside each other. Tubulars form the at least one second tubing portion. The number of tubulars and their radii are preferably optimized depending on the specific flow conditions and applications. The wall surface has considerably increased compared to the existing solutions allowing more liquids to be transported along the walls and via the core gas phase.

Objects, advantages and novel features, and further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more embodiments of the invention and are not to be construed as limiting the invention. In the drawings.

Figure 4:
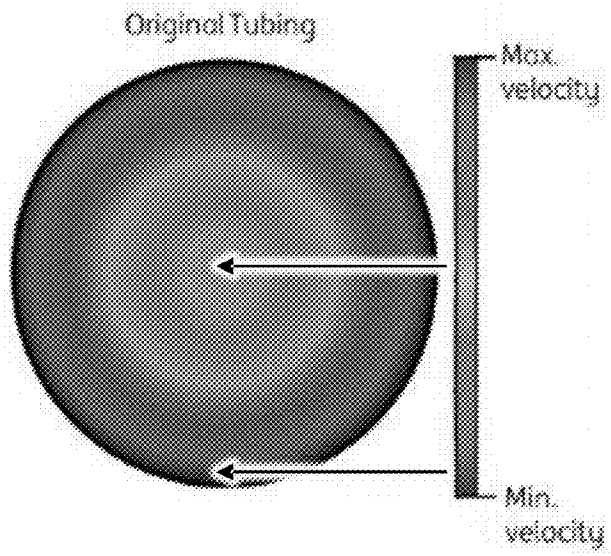
Figure 5:
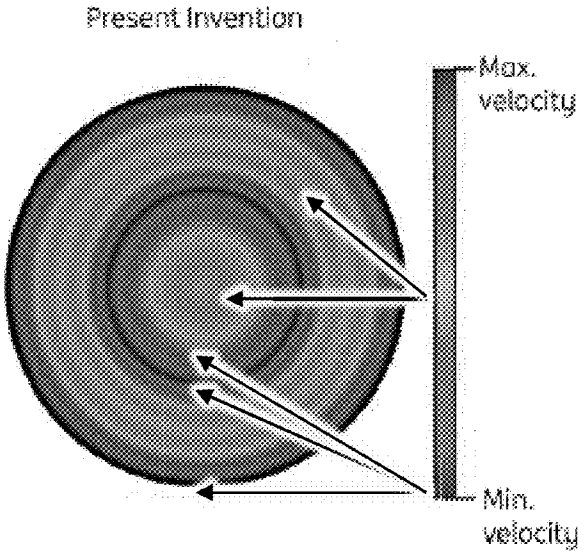
Figure 6:
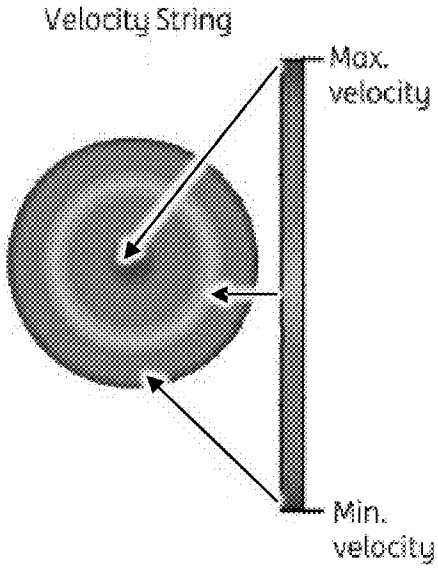
Figure 7:
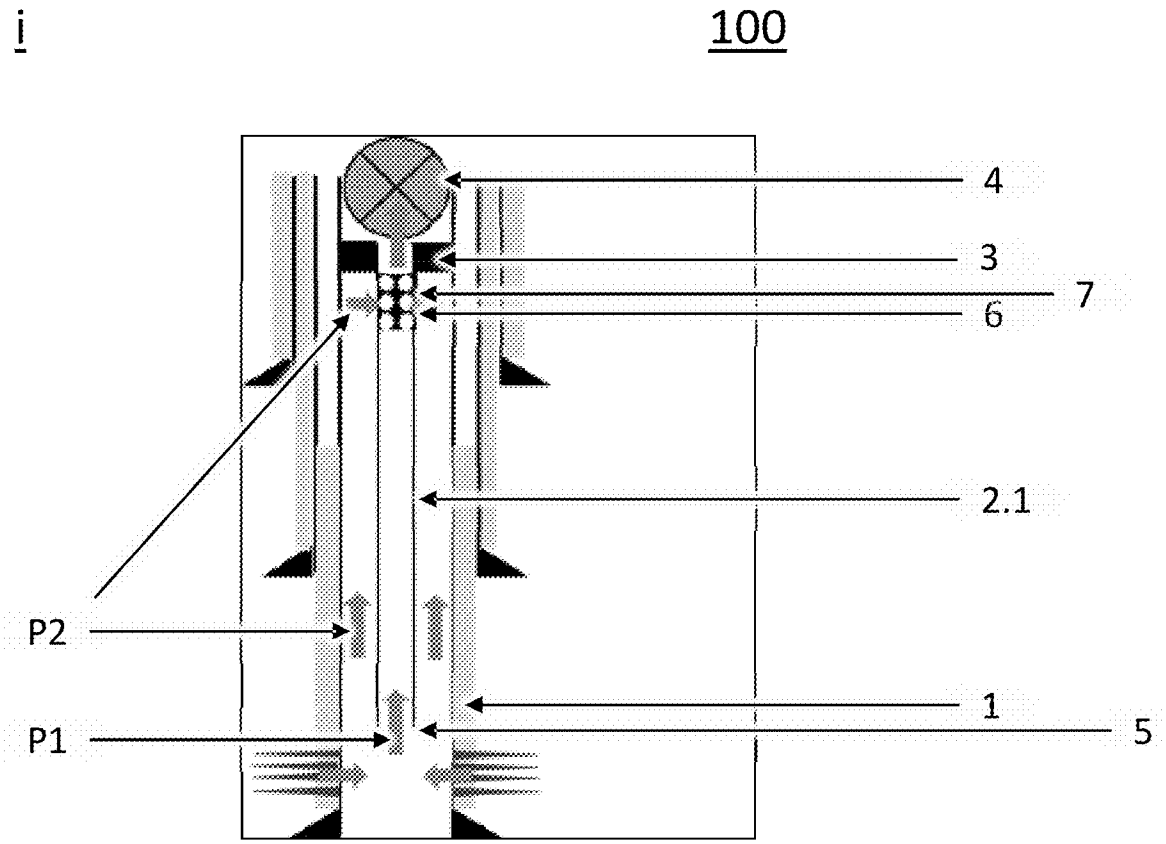
Figure 8:
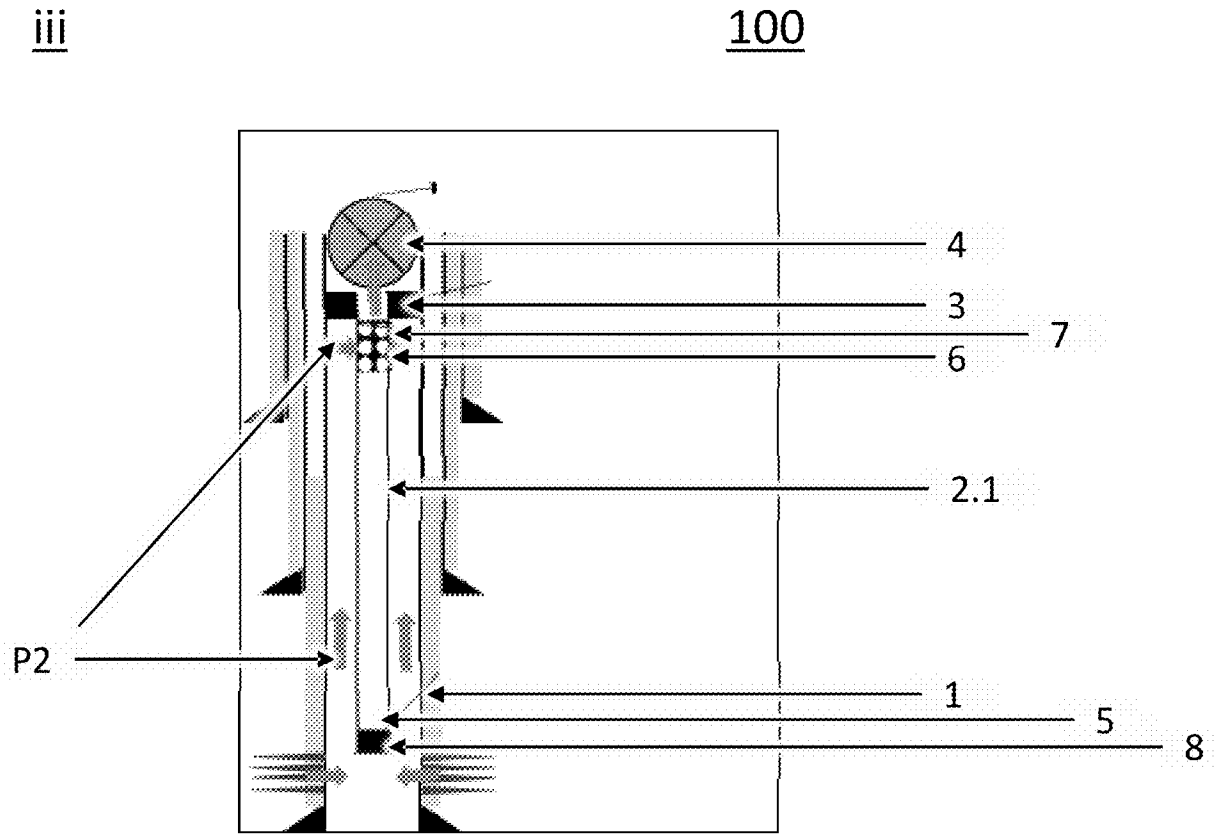
Figure 9:
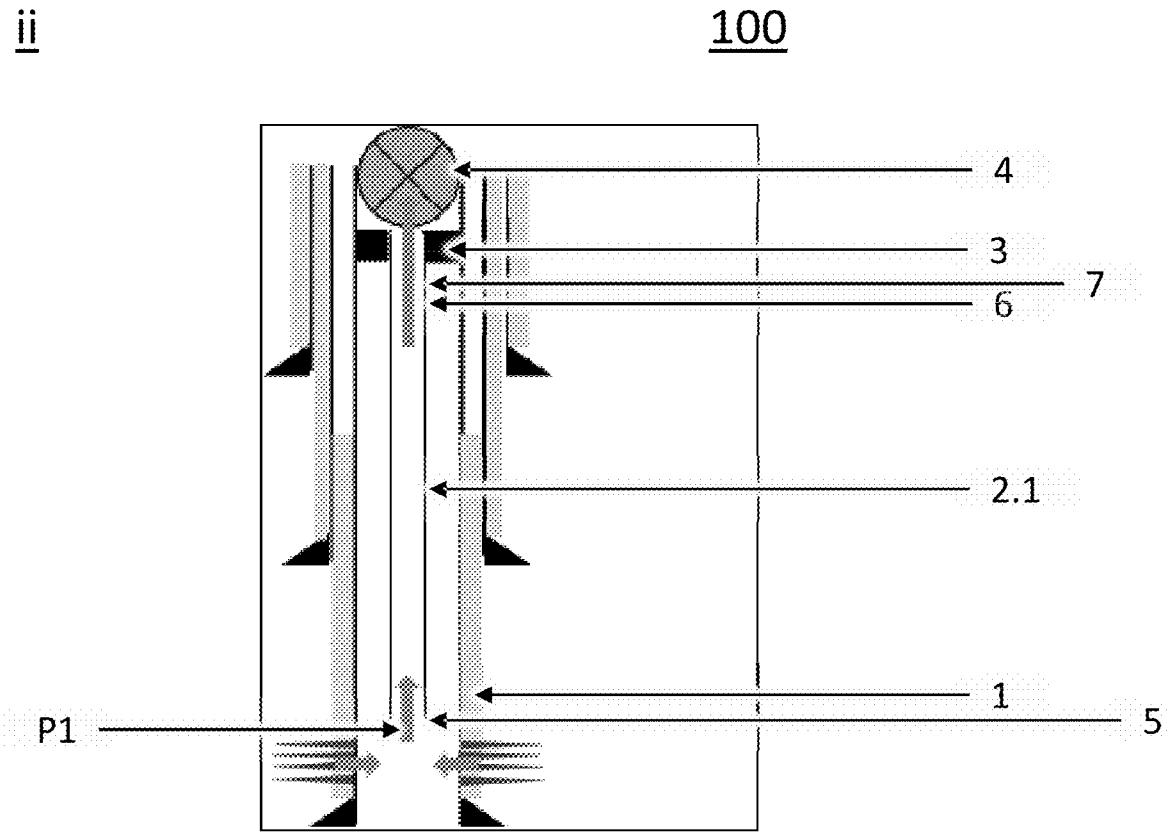
Figure 10:
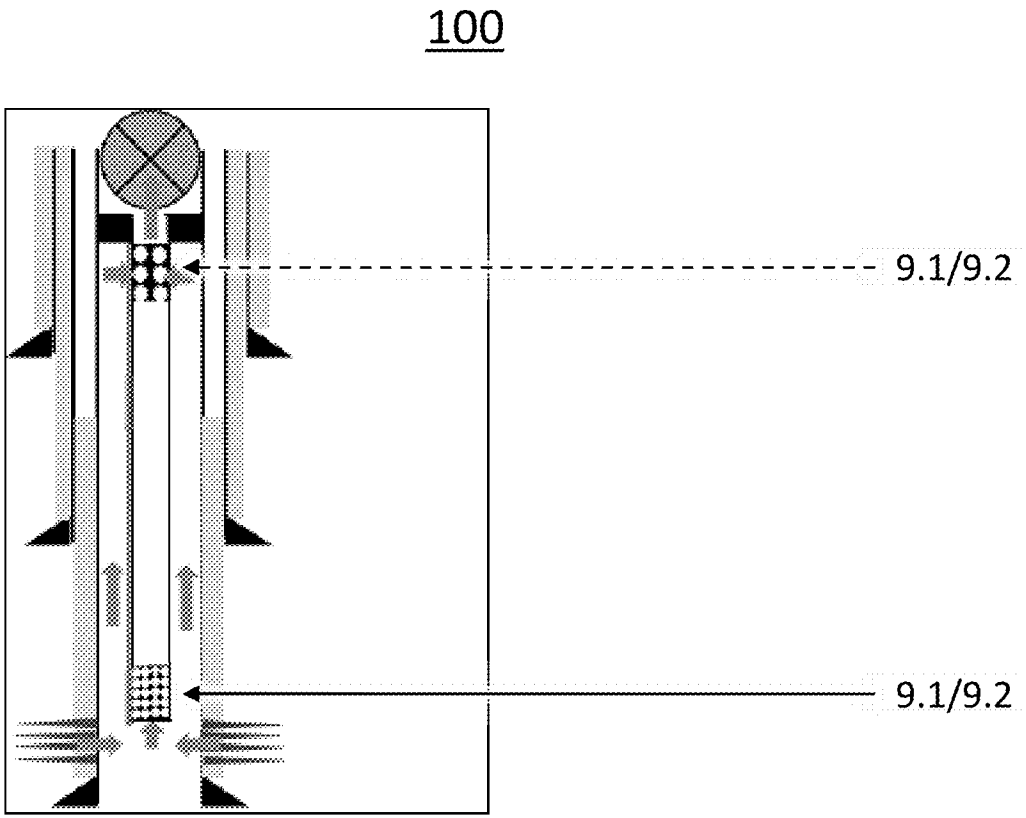

tubular;

FIG. 4 is an illustration showing a gas-phase velocity profile of a typical or original tubular;

FIG. 5 is an illustration showing a gas-phase velocity profile of an example concentric tubular according to an embodiment of the present invention;

FIG. 6 is an illustration showing a gas-phase velocity profile of an example of a velocity string according to an embodiment of the present invention;

FIG. 7 is a schematic illustration showing a second tubing portion including a packer hung inside of the first tube portion downstream of a safety valve according to an embodiment of the present invention;

FIG. 8 is a schematic illustration showing a tubing system with a retrievable plug arranged to cover the distal opening of a second tubing portion according to an embodiment of the present invention;

FIG. 9 is a schematic illustration showing a tubing system in which the sliding side door is closed and the system operates in the second operational mode according to an embodiment of the present invention; and FIG. 10 is a schematic illustration showing a tubing system equipped with a sand control and/or a filter device according to an embodiment of the present invention.

DETAILED DESCRIPTION OF THE INVENTION

Whenever in the figures the same reference numerals are applied, these numerals refer to the same parts.

Figure 1:
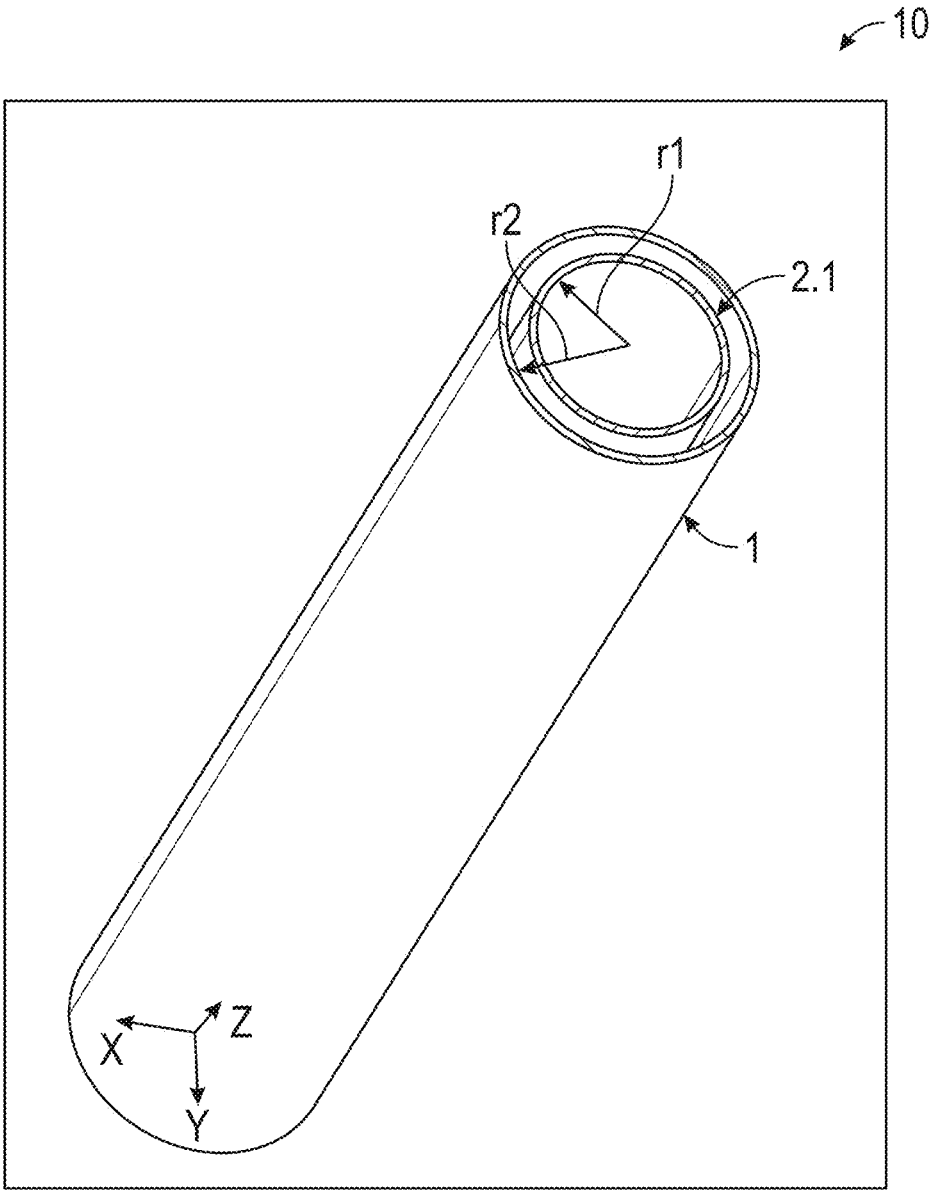
FIG. 1 is an illustration showing a perspective view of a pathway section of a tubing system according to an embodiment of the present invention.

FIG. 1 shows a pathway section 10 of the tubing system 100 (shown in FIG. 7-10) for transporting a gas-liquid flow from a petroleum wellbore to a production point (not shown, but customary). First tubing portion 1 and one second tubing portion 2.1 is disposed within said first portion such that both are substantially concentrically arranged. Second tubing portion 2.1 is preferably a velocity string and the first tubing portion 1 represents the customary tubing, the space between which is also known as the annulus.

Figure 2:
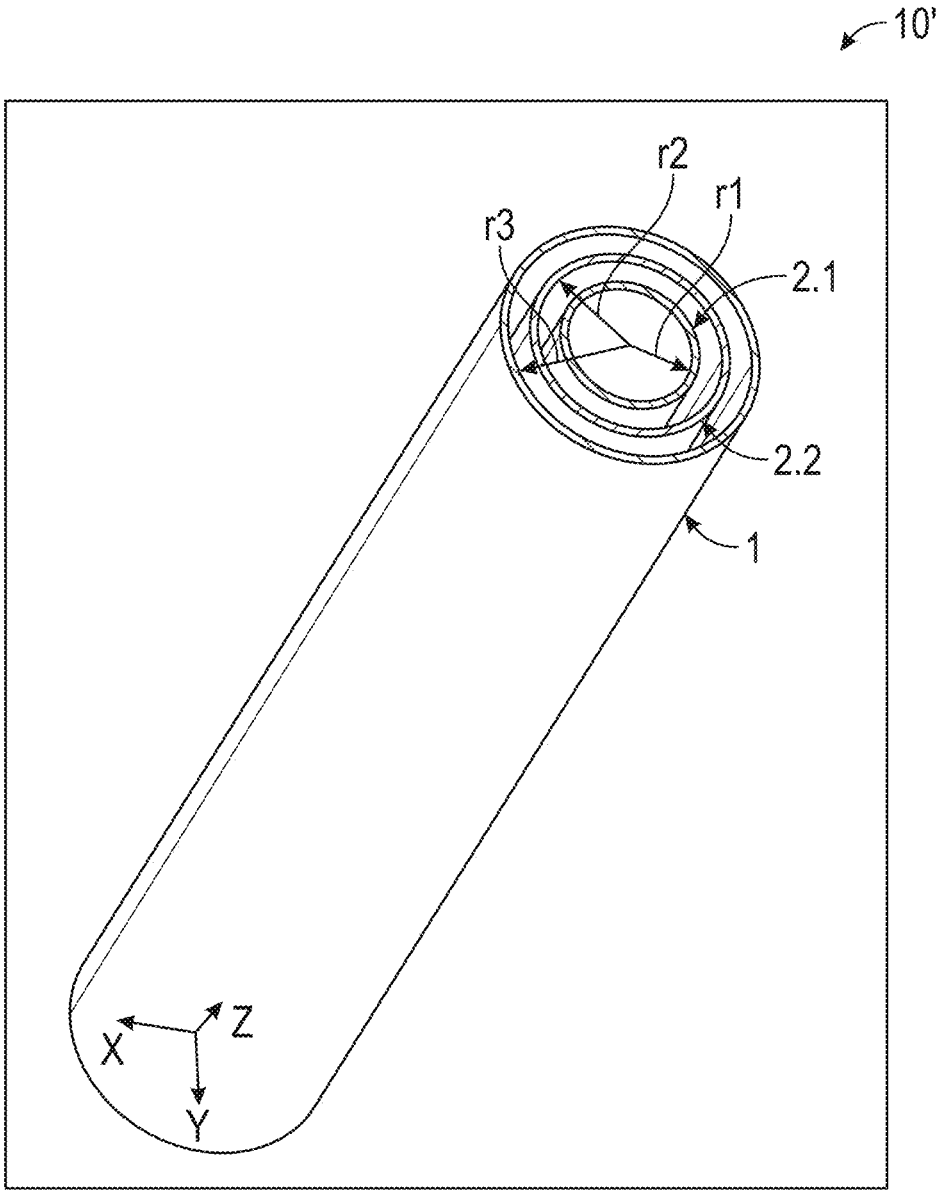
FIG. 2 is an illustration showing a perspective view of another pathway section of a tubing system according to an embodiment of the present invention.

FIG. 2 shows another pathway section 10' in which the at least one second tubing portion consist of two tubing portions 2.1, 2.2 each concentrically arranged, also with respect to the first tubing portion 1. In these figures tubing portion 2.1 always represents the center most tubing portion. The multiple tubing portions are sometimes also referred to as tubulars.

Figure 3:
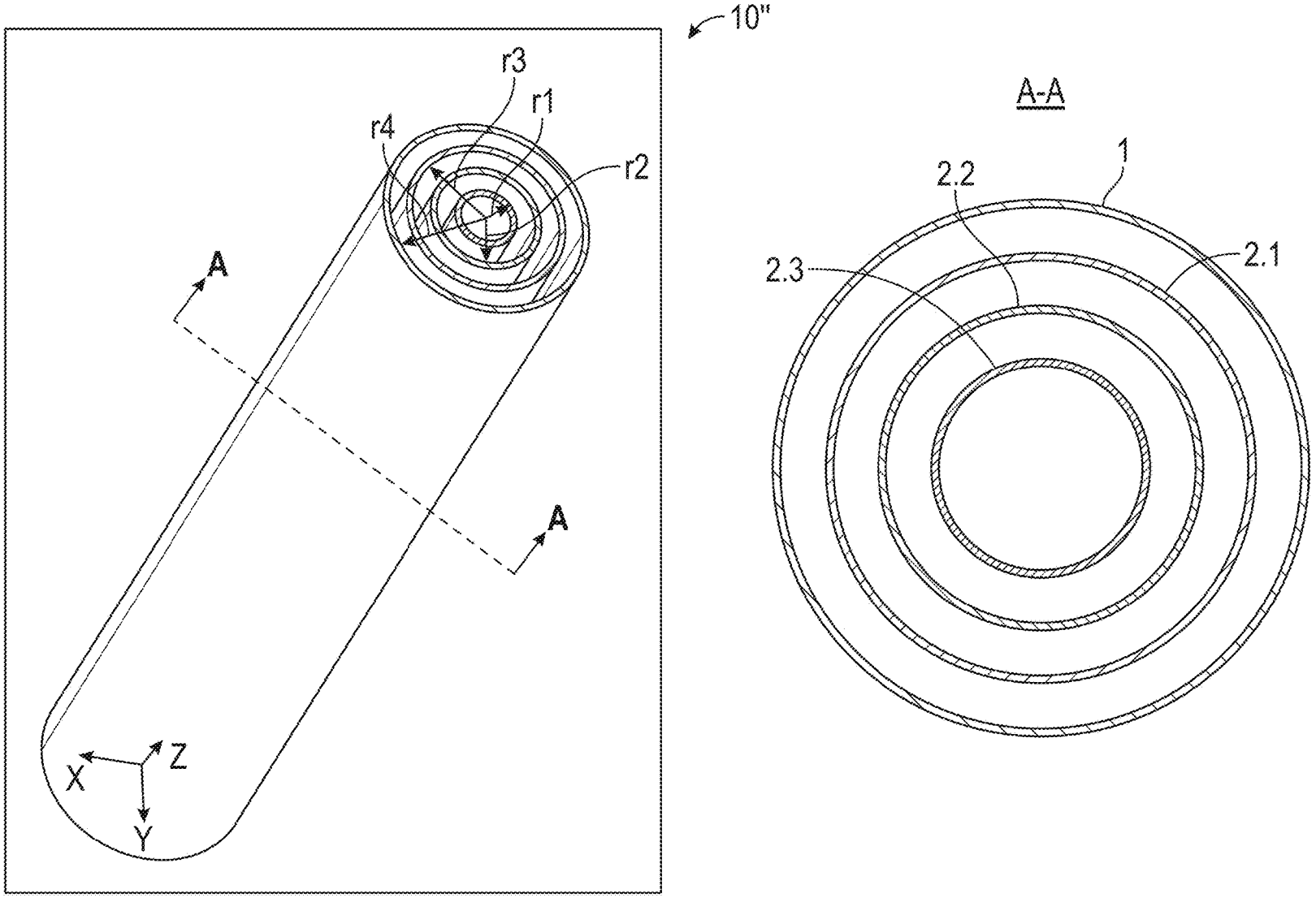
FIG. 3 is an illustration showing a perspective view and cross sectional view of another pathway section of a tubing system according to an embodiment of the present invention.

FIG. 3 shows yet another pathway section 10". Here the at least one second tubing portion consist of three tubing portions 2.1, 2.2, 2.3 each concentrically arranged within the first tubing portion. Progressing from the system of FIG. 1 to FIG. 3, substantially no cross-sectional flow area is lost. That is to say, the loss is limited within about several percent due to the fact that the only loss in area is due to the thickness of the walls of the tubulars. For clear visualization, a cross-sectional portion A-A has been exemplified to the right of the concentric first and second tube portions 1, 2.1, 2.2, 2.3.

FIGS. 1-3 do not show all features or embodiments of the invention, but exemplify a manner of assembly. Additional features and details of system 100 are schematically shown in FIGS. 7-10.

FIG. 7 shows that second tubing portion 2.1 comprises packer 3 with which it is hung inside of first tube portion 1 downstream of safety valve 4. In this example, the safety valve is a sub-surface safety valve, which means the well can be closed before any of the flow ever reaches the surface. The gas-liquid flow exclusively enters the first tubing portion above packer 3 via second tubing portion 2.1. The flow can be seen to take two distinct flow paths, namely first flow path P1 and second flow path P2. First flow path P1 is fairly straight forward and extends from an opening at distal end 5 of the second tubing portion to the first portion above the packer. Second flow path P2 extends along the outer surface of the second tubing portion as well as along the inner surface of the first tubing portion up along both tubing portions to lateral opening 6 furnished in the second tubing below packer 3. Both the first and second flow paths merge below the packer. The system further comprises sliding side door 7 arranged for covering lateral opening 6 to enable reversibly switching the system between a first operational mode (i) in which the first and second flow paths are simultaneously enabled, and a second operational mode in which only the first flow path is enabled (ii). Lateral opening 6 is preferably disposed directly below the packer 3, such that the second flow path extends along about 90% to about 100% of the entire length of the at least one second tubing portion below the packer.

FIG. 9 shows the situation in which sliding side door 7 is closed and system 100 operates in the second operational mode (ii).

FIG. 8 shows that system 100 may comprise retrievable plug 8 arranged to cover the distal opening of the at least one second tubing portion. That is to say, to block the first flow path P1. Plug 8 is designed for being manipulated so as the switch the system between a first operational mode in which the first and second flow paths are simultaneously enabled, and a third operational mode (iii) in which only the second flow path is enabled. By having both a plug and a sliding side door, one can beneficially close both, thus having a second safety feature for blocking the flow much like the safety valve. This would be beneficial as a double security feature. FIG. 8 thus shows this third operational mode (iii). While not shown in FIG. 8, the location of the retrievable plug may alternatively be just within and immediately below the SSD, for example, within about zero meters to about 10 meters.

FIG. 10 shows that system 100 may comprise sand control 9.1 and/or filter device 9.2, disposed on or coordinating with second tubing portion 2.1. In this example, system 100 operates in the first mode (i).

The changes in the flow profile between system 100 operating in the first mode (i) and a singular tube according to the prior art is best reflected in FIGS. 4-6, of which FIG. 5 is reflective of the invention operating in the first mode (i).

FIGS. 4-6 depict the gas-phase velocity profile in an example concentric tubulars (FIG. 5) compared to the original tubular (FIG. 4) and a velocity string (FIG. 6) based on the same flow boundary conditions. As it is shown, the velocity distribution over the concentric tubular cross-section (FIG. 5) is different with higher velocity variation in radial direction (dV/dr) and larger wall surface compared to an original tubular layout utilizing more gas-phase energy to transport the liquids along the tubular walls. The velocity string solution (FIG. 6) has a higher velocity and higher velocity variation in radial direction than the original tubular impacting liquid movement, but a lower wall surface and flow area, thereby limiting the unloading capacity. Shear stress which is dependent on the velocity distribution, and exercised by the annular gas phase on the liquid phase flowing along the walls of a pipe is proportional to the velocity variation in radial direction (dV/dr). In essence a higher dV/dr results in a higher shear stress. The foregoing description of preferred and other embodiments is not intended to limit or restrict the scope or applicability of the inventive concepts conceived of by the applicants. It will be appreciated with the benefit of the present disclosure that features described above in accordance with any embodiment or aspect of the disclosed subject matter can be utilized, either alone or in combination, with any other described feature, in any other embodiment or aspect of the disclosed subject matter.

Embodiments of the present invention have been made and described in relation to existing techniques and previous inventions as described above, and an object of the present invention is to define a method and equipment for maximum liquid transport in multi-phase pipes while avoiding the disadvantage of (partially) loss of energy from the gas phase in the pipe during the liquid transport is minimized. Based on the physical principle of the invention and due to the resulting design of the equipment, the efficiency of using the energy from the gaseous phase in the pipes is greatly increased. The invention optimizes the velocity distribution of the gas phase across the cross-section of the conduit and the annuli so as to achieve maximum impact of gas phase energy on the liquid transport along the walls.

By increasing the wall surface area of the pipes available for liquid transport, using the described devices (FIGS. 1-3 & FIGS. 7-10), the liquid phase will flow more efficiently through the pipes, with the gas phase in the center of the pipes and the liquid phase mainly along the walls of the pipes. Embodiments of the present invention make more wall surface available for liquid transport, which results in a greater liquid lifting capacity, and optimize gas velocity distribution over the cross-section of the pipes, which results in a greater upward shear stress exerted by the gas phase on the liquid phase. The series of devices described in the invention increase the wall area of conduits available for fluid transport and the resulting fluid lifting capacity over the existing single production conduit. The principle of the invention differs from the currently widely used technical solutions for lifting liquids from oil and gas wells, such as the so-called 'velocity string' which mainly increases the velocity of the gas phase in the single vertical pipe by reducing the pipe diameter, while also limiting the throughput surface.

Referring to the series of devices described in FIGS. 1-3, the number of pipes and their radii are preferably optimized to achieve maximum liquid transport. Embodiments of the present invention may comprise any number of pipes, and more than the four pipes illustrated in FIG. 3. Depending on the application, a tailor-made pipe system will be calculated both in terms of the number of pipes and their diameters. The piping system of the invention can be installed as a separate tubing system or can be installed in the production well as a coiled tubing.

Embodiments of the present invention may comprise a combination of small size tubular/pipe in an existing installed larger size tubing together with a so called "Sliding Side Door ("SSD") device" (open/close sliding valve), and a so-called "retrievable plug". Both the SSD and the plug can be opened and/or removed by means of so-called "slickline tools" (oil/gas well treatment device by means of a thin steel wire in the production line), so that an optimal tubing configuration is created and can be adjusted during the production operation (FIGS. 7-9). The invention can also be equipped with a sand filter and a chemical injection line (FIG. 10).

Additional embodiments of the present invention are further described below.

Another embodiment of the present invention is directed to a method of installing a multi string (sometimes consisting of a "velocity string") in a wellbore tubing with a combination of one or more of the following elements described in FIGS. 7-10, with the purpose of increasing the flow capacity in vertical or deviated multi-phase flow conduits by ca. 50%-300% compared to existing industry solutions. The present invention makes use of coiled tubing or threaded tubing with a combination of (i) sliding side door, (ii) a retrievable plug, (iii) various sand control and/or filter devices which can be mounted at the bottom of the tubular devices, (iv) one of the tubulars or a dedicated injection line can be used for transporting special fluids down the flow device such as corrosion inhibitor, foam, acid, scale inhibitor, etc. in order to mitigate potential flow assurance issues, and (v) the proprietary dynamic simulation computational tool is used to define the optimum tubular solution (number of tubulars and their radii and optimize timing to switch from one tubular configuration to another), in order to maximize the liquid unloading capacity and flow capacity.

Another embodiment of the present invention is directed to the method of claim 1 including a multi string tubular with design in accordance with FIGS. 1-3, and the potential combination of one or more of the other elements described in claim 1 above.

Optionally, embodiments of the present invention can include a general or specific purpose computer or distributed system programmed with computer software implementing steps described above, which computer software may be in any appropriate computer language, including but not limited to C++, FORTRAN, BASIC, Java, Python, Linux, assembly language, microcode, distributed programming languages, etc. The apparatus may also include a plurality of such computers/distributed systems (e.g., connected over the Internet and/or one or more intranets) in a variety of hardware implementations. For example, data processing can be performed by an appropriately programmed microprocessor, computing cloud, Application Specific Integrated Circuit (ASIC), Field Programmable Gate Array (FPGA), or the like, in conjunction with appropriate memory, network, and bus elements. One or more processors and/or microcontrollers can operate via instructions of the computer code and the software is preferably stored on one or more tangible non-transitive memory-storage devices.

Embodiments of the present invention can include every combination of features that are disclosed herein independently from each other. Although the invention has been described in detail with particular reference to the disclosed embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference. Unless specifically stated as being "essential" above, none of the various components or the interrelationship thereof are essential to the operation of the invention. Rather, desirable results can be achieved by substituting various components and/or reconfiguration of their relationships with one another. The terms, "a", "an", "the", and "said" mean "one or more" unless context explicitly dictates otherwise. Note that in the specification and claims, "about" or "approximately" means within twenty percent (20%) of the numerical amount cited.

Any reference to first or second embodiments or aspects of the invention are not intended to describe a best mode or a hierarchy of preferred embodiments. Such references are only for purposes of reference and ease of reading.

What is claimed is:

1. A computer implemented method comprising:

(a) simulating a system with a predetermined number of concentric second tubing portions of predefined radii, wherein the system comprises:

a tubing system for transporting a gas-liquid flow from a petroleum wellbore to a production point, the tubing system comprising a pathway section in fluid communication with the wellbore and the production point, the section comprising:

a first tubing portion directing the flow towards the production point;

at least one second tubing portion disposed within the first tubing portion, wherein the at least one second tubing portion comprises a packer, wherein the at least one second tubing portion is disposed within the first tubing such that the flow exclusively enters the first tubing portion above the packer via the at least one second tubing portion, and wherein the at least one second tubing portion comprises a lateral opening and a distal opening for enabling a first flow path from the distal opening towards the first tubing portion, and enabling a second flow path from the distal end of the first tubing portion and the lateral opening, wherein the second flow path extends along an outer surface of the second tubing portion as well as along an inner surface of the first tubing portion to the lateral opening disposed in the second tubing below the packer, and wherein both the first and second flow paths merge below the packer in the at least one second tubing portion, and comprising a sliding side door arranged for covering the lateral opening to enable reversibly switching the system between a first operational mode in which the first and second flow paths are simultaneously enabled, and a second operational mode in which only the first flow path is enabled;

(b) changing the number of concentric tubing portions that make up the plurality within a predefined range and/or the respective radii within a predefined range, and repeating the simulation step (a);

(c) iterating towards a simulated final system with a higher simulated liquid unloading capacity and/or flow capacity by repeating step (b); and (d) providing a system having a first tubing portion with at least second tubing portions such that it corresponds to the simulated final system.

2. The method according to claim 1 wherein the system further comprises a safety valve above the packer, wherein the safety valve is operable for blocking the flow to the production point in its entirety.

3. The method according to claim 1 wherein the system further comprises a retrievable plug arranged within the at least one second tubing portion below the sliding side door so as to reversibly block the first flow path, wherein the plug is designed for being manipulated within the at least one second tubing portion so as to switch the system between a first operational mode in which the first and second flow paths are simultaneously enabled, and a third operational mode in which only the second flow path is enabled.

4. A method of using the tubing system according to claim 3, comprising the step of operating the sliding side door and/or plug to switch between any one of the first, second and third operational modes.

5. The method according to claim 1, wherein the lateral opening of the at least one second tubing portion is disposed directly below the packer, such that the second flow path extends along about 90% to about 100% of the entire length of the at least one second tubing portion below the packer.

6. The method according to claim 1 wherein the system further comprises a sand control and/or a filter device disposed on or coordinated with the at least one second tubing portion.

7. The method according to claim 1, wherein the at least one second tubing portion comprises a plurality of substantially parallel tubing portions, each comprising a velocity string.

8. The method according to claim 1, wherein the at least one tubing portion comprises a plurality of substantially concentric tubing portions, wherein the second flow path is further subdivided in a plurality of sub-paths which also extend between inner and outer surfaces of the concentric tubing portions.

9. A method of constructing a tubing system according to claim 1, comprising the following steps:

providing the first tubing portion;

providing the at least one second tubing portion;

lowering the at least one second tubing portion into the first tubing portion, such that the at least one second tube portion hangs in the first tube portion on the packer.

* * * * *